United States Patent [19]

Cook et al.

[11] Patent Number: 4,959,131

[45] Date of Patent: Sep. 25, 1990

[54] GAS PHASE $CO_2$ REDUCTION TO HYDROCARBONS AT SOLID POLYMER ELECTROLYTE CELLS

[75] Inventors: Ronald L. Cook, Aurora; Anthony F. Sammells, Naperville, both of Ill.

[73] Assignee: Gas Research Institute, Chicago, Ill.

[21] Appl. No.: 257,727

[22] Filed: Oct. 14, 1988

[51] Int. Cl.[5] ..... C25B 3/04

[52] U.S. Cl. ..... 204/59 R; 204/73 R; 204/252; 204/282; 204/290 R; 204/292

[58] Field of Search ..... 204/59 R, 128, 129, 204/292, 282-283, 73 R, 80, 252, 296, 290 R

[56] References Cited

PUBLICATIONS

Petrova G. N. and O. N. Eflimova, Electrokhimiya, 91(7), 978 (1983).

Frese, Jr.; K. W. and S. Leach, J. Electrochem. Soc., 132, 259 (1985).

Hori, Y. K. Kikuchi and S. Suzuki, Chem. Lett., 1695 (1985).

Hori, Y. K. Kikuchi, A. Murata and S. Suzuki, Chem. Lett., 897 (1986).

Hori, Y. A. Murata, R. Takahashi and S. Suzuki, J. Chem. Soc., Chem. Commun., 17, (1988).

Hori, Y., A. Murata, R. Takahashi and S. Suzuki, J. Am. Chem. Soc., 109, 5022 (1987).

Hori, Y., A. Murata, R. Takashasi and S. Suzuki, Chem. Lett., 1665 (1987).

Cook, R. L., R. C. McDuff and A. F. Sammells, J. Electrochem. Soc., 134, 1873 (1987).

Dewulf, D. W., A. J. Bard, Cat. Lett. 1, 73, (1988).

Cook, R. L., R. C. MacDuff and A. F. Sammells, J. Electrochem. Soc., 135, 1470 (1988).

DeWulf, D. W., A. J. Bard, Cat. Lett. 1,73 (1988).

Cook, R. L., R. C. MacDuff and A. F. Sammells, J. Electrochem. Soc., 135, 1470 (1988).

Cook, R. L., R. C. MacDuff and A. F. Sammells, J. Electrochem. Soc., 134, 1873 (1987).

*Primary Examiner*—John F. Niebling

*Assistant Examiner*—Kathryn Gorgos

*Attorney, Agent, or Firm*—Thomas W. Speckman; Douglas H. Pauley

[57] ABSTRACT

A process and apparatus for gas phase electrochemical reduction of $CO_2$ and/or CO to hydrocarbons at ambient temperatures. The process is carried out by passing an electrical current between a cathode in contact with one side of a hydrogen ion conducting solid polymer electrolyte and an anode in ionic communication with the opposite side of the solid polymer electrolyte. In one embodiment, the anode material may be in contact with the opposite side of the hydrogen ion conducting solid polymer electrolyte, and in another embodiment, an anode may be separated from the opposite side of the solid polymer electrolyte by an aqueous inorganic salt solution. At least one of $CO_2$ and CO are passed in contact with the cathode and hydrogen ions passing through the solid polymer electrolyte reduce at least a portion of the $CO_2$ and CO to gaseous hydrocarbon products such as $CH_4$ and $C_2H_4$ at the solid polymer electrolyte/cathode interface.

26 Claims, 2 Drawing Sheets

GAS PHASE $CO_2$ REDUCTION TO HYDROCARBONS AT SOLID POLYMER ELECTROLYTE CELLS

BACKGROUND OF THE INVENTION

1. Field of the Invention

This invention relates to a process for gas phase electrochemical reduction of $CO_2$ and/or CO to $CH_4$ and $C_2H_4$ at ambient temperatures. The process is carried out at a solid polymer electrolyte wherein a metal electocatalyst capable of providing adsorption sites for $CO_2$ and/or CO and chemisorbed hydrogen species or faradaically generated hydrogen species in proximity to the adsorbed $CO_2$ and/or CO is deposited on one side of the solid polymer electrolyte to function as a cathode. $CO_2$ and/or CO is passed in contact with the electrocathode while hydrogen ion is passed through the solid polymer electrolyte from an anode portion of the cell capable of providing hydrogen. Formation of hydrocarbons occurs during electrochemical reduction of $CO_2$ and CO at the metal/solid polymer electrolyte interface.

2. Description of the Prior Art

Considerable effort has been expended towards promoting the electrochemical reduction of $CO_2$ to useful hydrocarbons at both high Faradaic efficiencies and high current densities.

Indirect reduction of $CO_2$ on a mercury electrode in an aqueous electrolyte, pH 7, containing $TiCl_3$, $Na_2MoO_4$ and pyrocatechol where the total Faradaic efficiency for cathodic hydrocarbon generation was about 0.2 percent at 7mA/cm$^2$, with methane being the major hydrocarbon component is taught by Petrova, G.N. and O.N. Efimora, Elektrokhimiya, 19(7). 978 (1983). $CO_2$ has been shown to be reducible to $CH_4$, CO, and methanol at ruthenium cathodes in $CO_2$ saturated aqueous $Na_2SO_4$ electrolyte with Faradaic efficiencies for $CH_4$ production up to 42 percent at current densities up 0.11mA/cm$^2$ by Frese, Jr., K.W. and S. Leach, J. Electrochem. Soc., 132, 259 (1985).

Copper, 99.99 percent pure, was used as a cathode with 0.5M $KHCO_3$ electrolyte for the electrochemical reduction of $CO_2$ at ambient temperature and current density of 5.0mA/cm$^2$ for 30 to 60 minutes with Faradaic efficiencies for $CH_4$ of 37 to 40 percent, Hori, Y, K. Kikuchi and S. Suzuki, Chem. Lett., 1695 (1985). In later work high purity copper cathodes, 99.999 percent, were used for the electrochemical reduction of $CO_2$ in 0.5M $KHCO_3$ electrolyte in a cell operated at a current of 5mA/cm$^2$ for 30 minutes at temperatures of 0° C. and 40° C. shows Faradaic efficiency for production of $CH_4$ drops from 60 percent at 0° to 5 percent at 40° ; $C_2H_4$ increases from 3 percent at 0° to 18 percent at 40° ; while hydrogen production increases from 20 percent at 0° to 45 percent at 40° . It is stated that 99.99 percent pure copper cut the Faradaic efficiencies to about one-third of those obtained with 99.999 percent pure copper. Hori, Y, K. Kikuchi, A. Murata and S. Suzuki, Chem. Lett., 897 (1986). Later work of electrochemical reduction of $CO_2$ at a 99.999 percent pure copper cathode in aqueous electrolytes of KCl, $KClO_4$and $K_2SO_4$ at 19° C. and current density of5mA/cm$^{-2}$ showed Faradaic yields of $C_2H_4$ of as high as in the order of 48 percent, $CH_4$ 12 percent and EtOH 21 percent. Hori, Y, A. Murata, R. Takahashi and S. Suzuki, J. Chem. Soc., Chem. Commun, 17, 1988.

Electroreduction of CO at a 99.999 percent pure copper cathode in an aqueous catholyte of $KHCO_3$ at ambient temperature for 30 minutes showed hydrogen the predominant product and at 1.OmA/cm$^2$ $C_2H_4$ Faradaic production was 22 percent, $CH_4$ 1 percent; 2.5mA/cm$^2$ $C_2H_4$ Faradaic production was 21 percent, $CH_4$16 percent and at 5.0mA/cm$^2$ $C_2H_4$ Faradaic production was 16 percent, $CH_4$ 6 percent Hori, Y, A. Murata, R. Takahashi and S. Suzuki, J. Am. Chem. Soc., 109. 5022 (1987). Similar work by the same authors showed electroreduction of CO at a 99.999 percent pure copper cathode in an aqueous 0.1 M $KHCO_3$ pH 9.6 catholyte at 19° C. at 2.5mA/cm$^2$ resulted in Faradaic production $C_2H_4$ of 21.2 percent; $CH_4$ of 16.3 percent; EtOH of 10.9 percent; and 45.5 percent $H_2$. Hori, Y, A. Murata, R. Takahashi and S. Suzuki, Chem. Lett., 1665 (1987).

In the reduction of $CO_2$ to $CH_4$ using 99.9 percent pure cold rolled B 370 copper cathodes with a $CO_2$ saturated 0.5M $KHCO_3$ electrolyte, Faradaic efficiencies of 33 percent were achieved for $CH_4$ at current densities up to 38 mA/cm$^2$ with no $C_2H_4$ being detected. Cook, R.L., R. C. McDuff and A.F. Sammells, J. Electrochem. Soc., 134, 1873 (1987).

Electrochemical reduction of $CO_2$ to $CH_4$ and $C_2H_4$ was shown to occur at copper/ --NAFION perfluorinated sulfonic acid copolymer--electrodes (solid polymer electrolyte structures) at Faradaic efficiencies of about 9 percent for each $CH_4$ and $C_2H_4$ at E=-200V vs. SCE using 2mM $H_2SO_4$ counter solution at a temperature of 22° C. Dewulf, D.W., A.J. Bard, Cat. Lett. 1, 73, (1988). The Dewulf et al article was received Jan. 4, 1988 and published in February 1988 while a portion of the present invention was published in June 1988 from a manuscript submitted Oct. 7, 1987 and a revised manuscript received Dec. 17, 1987: Cook, R.L, R.C. MacDuff and A.F. Sammells, J. Electrochem. Soc., 135. 1470 (1988).

SUMMARY OF THE INVENTION

The process of this invention provides electrochemical reduction of gas phase $CO_2$ and CO to hydrocarbons, such as $CH_4$, $C_2H_4$ and $C_2H_6$ at solid polymer electrolyte cells. A metal electrocatalyst capable of providing adsorption sites for $CO_2$ and/or CO and chemisorbed hydrogen species or faradaically generated hydrogen species in proximity to the adsorbed $CO_2$ and/or CO is deposited on one side of the solid polymer electrolyte to function as a cathode. Suitable solid polymer electrolytes may be any hydrogen ion passing membrane such as perfluorinated sulfonic acid copolymers, including NAFION 417 and NAFION 117. The counter half-cell may be any configuration providing hydrogen or hydrogen ions to the opposite side of the solid polymer electrolyte. In one embodiment, the counterelectrode may be any metal capatable with electrochemical hydrogen oxidation, such as known to the art for hydrogen fuel cells, deposited directly on the opposite surface of the solid polymer electrolyte. In other embodiments, the counter half-cell may be an aqueous electrolyte capable of providing hydrogen ions to the opposite surface of the solid polymer electrolyte and a metal electrode.

The process for gas phase electrochemical reduction of $CO_2$ and/or CO to gaseous hydrocarbon products according to this invention comprises passing a current between a cathode in contact with one side of a hydrogen ion conducting solid polymer electrolyte and an anode in ionic communication with the opposite side of the solid polymer electrolyte. Gaseous $CO_2$ and/or CO is passed in contact with the cathode which comprises a metal electrocatalyst deposited on the solid polymer electrolyte and is capable of providing adsorption sites for $CO_2$ and CO and chemisorbed hydrogen species and faradaically generated hydrogen species in proximity to the adsorbed $CO_2$ and CO so that hydrogen ions passing through the solid polymer electrolyte from the anode reduce at least a portion of the $CO_2$ and CO to gaseous hydrocarbon products comprising $CH_4$ and $C_2H_4$ at the solid polymer electrolyte/cathode interface. The gaseous hydrocarbon products are then removed from the region of the cathode.

BRIEF DESCRIPTION OF THE DRAWING

The above mentioned and other features of the present invention, and the manner of obtaining them, will become apparent and the invention will be best understood by reference to the following description of preferred embodiments read in conjunction with the accompanying drawing wherein.

DESCRIPTION OF PREFERRED EMBODIMENTS

Figure 1:
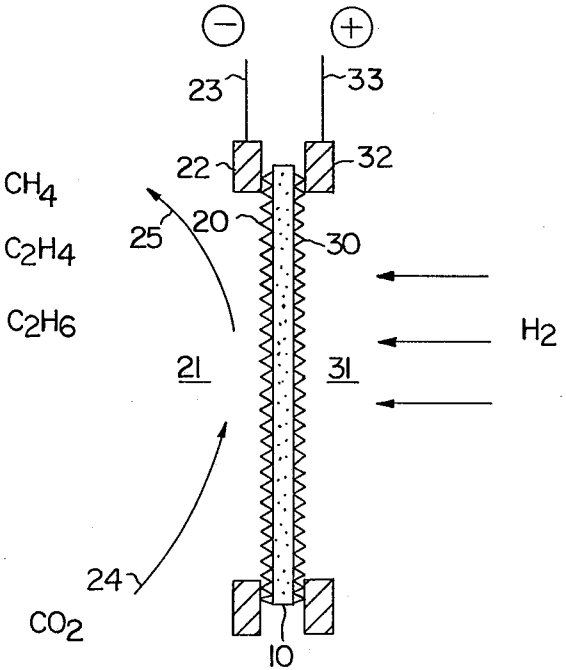
FIG. 1 is a schematic showing of a solid polymer electrolyte cell of one embodiment of this invention having the configuration $CO_2$/Cu/perfluorinated sulfonic acid copolymer/Pt/$H_2$(10%)$N_2$(90%)

A simplified schematic drawing of a solid polymer electrolyte cell of one embodiment of this invention is shown in FIG. 1. The cell is generally comprised of hydrogen ion conducting solid polymer electrolyte 10 with cathode metal electrocatalyst 20 deposited on one side and anode metal electrocatalyst 30deposited on the opposite side. Suitable solid polymer electrolytes may be any hydrogen ion passing membrane, such as perfluorinated sulfonic acid copolymers, NAFION 417 and NAFION 117 being preferred. The cathode metal electrocatalyst 20 may comprise a metal electrocatalyst capable of providing adsorption sites for $CO_2$ and chemisorbed hydrogen species and faradaically generated hydrogen species in proximity to adsorbed $CO_2$ and may include metals selected from the group consisting of copper, nickel, rhodium and ruthenium. Copper is a preferred cathode metal electrocatalyst for use in this invention. A film of the solid polymer electrolyte material, such as perfluorinated sulfonic acid copolymers, may be placed on the surface of cathode 20 to facilitate movement of hydrogen ion to the front face of the cathode thereby increasing the desired $CO_2$ and CO/-solid polymer electrolyte/cathode metal electrocatalyst interface for conduct of the desired reactions. Suitable loading of the cathode metal electrocatalyst 20on the solid polymer electrolyte 10 is about 0.01 to about 1 mg $cm^2$, about 0.05 to about 0.2 mg $cm^2$ being preferred. The cathode metal electrocatalyst may be deposited on the solid polymer electrolyte by electroless deposition by any means known to the art. In a similar manner anode metal 30 may be deposited on the opposite side of solid polymer electrolyte 20. Anode metal 30 may be any metal compatible with electrochemical hydrogen oxidation as known for use in hydrogen fuel cells, such as platinum, platinum alloys and ruthenium. The anode metal may be deposited on the solid polymer electrolyte by electroless deposition by any means known to the art, to provide a loading of about 0.01 to about 1 mg/$cm^2$, about 0.05 to about 0.2 mg/$cm^2$ being preferred.

As shown in FIG. 1, cathode 20 is in electrical contact with cathode mounting ring 22 which is in electrical contact with external electrical lead 23. Likewise, anode 30 is in electrical contact with anode mounting ring 32 which is in electrical contact with anode electrical lead 33. Cathode electrical lead 23 and anode electrical lead 33 are connected to an external electrical supply means, not shown, but well known to the art. Providing a current density of about 5 to about 50 mA/$cm^2$ and preferably current densities cf about 20 to about 30 mA $cm^2$ are suitable.

The cell is maintained within a confined chamber in a manner to provide closed cathode chamber 21 and closed anode chamber 31 in a fashion to provide cathode chamber feed 24 of $CO_2$ or CO to contact cathode 20 and product flow 25 to remove gaseous hydrocarbon products from the region of the cathode 20. Likewise, anode chamber 31 is provided with a suitable means for providing hydrogen to contact anode 30. Suitable means for providing desired flow are well known in the art. The $CO_2$ or CO and the hydrogen may be provided in association with non-electrochemically interfering gases.

Figure 2:
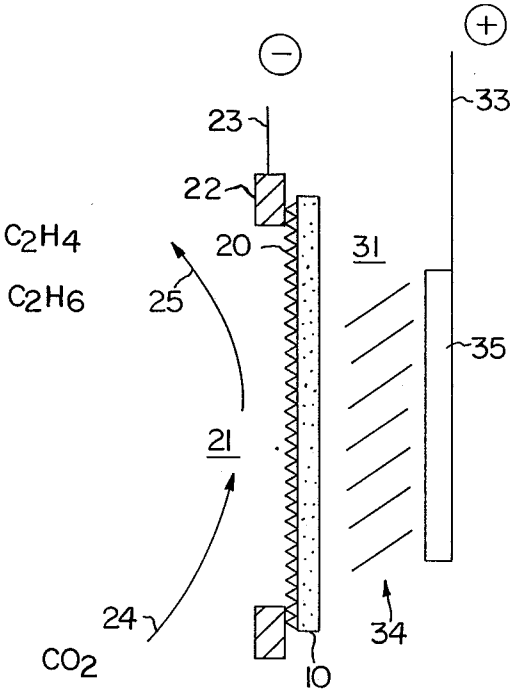
FIG. 2 is a schematic showing of a solid polymer electrolyte cell of one embodiment of this invention having the configuration $CO_2$/Cu/perfluorinated sulfonic acid copolymer/Aq.electrolyte/Pt.

The process of this invention schematically shown in the simplified schematic drawing of FIG. 2 shows solid polymer electrolyte 10with its cathode 20, cathode mounting ring 22, cathode external electrical lead 23, cathode chamber 21, cathode feed 24 and cathode product flow 25 as described with reference to FIG. 1. The counter half-cell shown in FIG. 2 has metal anode 35 separated from the opposite side of solid polymer electrolyte 10 by an aqueous inorganic salt solution or aqueous anolyte 34. Both metal anode 35 and aqueous anolyte 34 are within anode chamber 31. Metal anode 35 has anode electrical lead 33 leading to an electrical supply means together with cathode external electrical lead 23 as described with respect to FIG. 1. Suitable aqueous salt solutions for aqueous anolyte 34 include aqueous solutions of $KHCO_3NaHCO_3$, KCl, $KClO_4$, KOH, $KBF_4$, $K_2CO_3$, $K_2SO_4$, $KHSO_4$, $KH_2PO_4$, $K_2HOP_4$, preferably $K_2SO_4$, in concentrations of about 0.3 to 0.8 Molar, preferably about 0.4 to 0.6 Molar at pH preferably of about 4 to about 9. The aqueous anolyte under electrolytic cell operating conditions provides hydrogen ions to the surface of solid polymer electrolyte 10 facing aqueous electrolyte 34. There is preferably a high content of hydrogen ions in the region of the opposite side of solid polymer electrolyte 10 which faces aqueous electrolyte 34. The cell configuration shown in FIG. 2 has advantages over the cell configuration shown in FIG. 1 in that a more direct control of the chemical potential on the solid polymer electrolyte may be maintained. The $CO_2$ and CO reduction cell configuration shown in FIG. 2 also opens the possibilities for reactions in the anode half-cell other than hydrogen oxidation, for example, to provide routes for other organic synthesis, such as glucose oxidation at lead ruthenate electrode/solid polymer electrolyte or formic acid oxidation at palladium electrode/solid polymer electrolyte.

The cell configurations of FIGS. 1 and 2 also allow control of composition of gaseous hydrocarbon products. The configuration shown in FIG. 2 promotes methane formation due to the aqueous anolyte being capable of providing a higher concentration of hydrogen ions to the solid polymer electrolyte, and thus to the $CO_2$/cathode/solid polymer electrolyte electrochemical reduction site. Likewise, the lower hydrogen population at the $CO_2$/cathode/solid polymer electrolyte electrochemical reduction site obtained with the cell configuration in FIG. 1 results in C-C dimerization and thus control of hydrogen population may be used to increase ethylene formation.

While we do not wish to be bound by any mechanism for the process of this invention, our work indicates the reduction of $CO_2$ to $CH_4$ and $C_2H_4$ may follow the reaction path:

1. Electron transfer step to $CO_2$ adsorbed on cathode:

$$CO_{2\,ads} + e^- \longrightarrow \overset{\circ}{CO_2^-}_{ads}$$

2. Electron transfer forming adsorbed formic acid:

$$\overset{\circ}{CO_2^-}_{ads} + H_2O \longrightarrow .CO_2H_{ads} + OH^-$$

(carboxy radical intermediate)

$$.CO_2H_{ads} + H_2O + e^- \longrightarrow :C(OH)_{2\,ads} + OH^-$$

(oxymethylene)

$$:C(OH)_{2\,ads} \longrightarrow HCOOH_{ads}$$

3. Reduction of adsorbed formic acid:

$$HCOOH_{ads} + e^- \longrightarrow \overset{\circ}{HCOOH^-}_{ads}$$

followed by $$\overset{\circ}{HCOOH^-} \longrightarrow .CHO + OH^-$$

or $$\overset{\circ}{HCOOH^-} \longrightarrow HCOO^- + H$$

and an additional side reaction $$H + HCO_2 \longrightarrow H_2 + \overset{\circ}{CO_2^-}$$

4. Formation of product precursers:

$$HCOH_{ads} + e^- \longrightarrow CH_{ads} + OH^-$$

$$CO \longrightarrow C_{ads} + O_{ads}$$

$$C_{ads} + H_{ads} \longrightarrow CH_{ads}$$

$$HCOH \rightleftharpoons HCHO \text{ (isomerization)}$$

5. $CH_4$ and $C_2H_4$ formation:

$$CH_{ads} + H_{ads} \longrightarrow CH_{2\,ads}$$

-continued $$CH_{2\,ads} + H_{ads} \longrightarrow CH_{3\,ads}$$

$$CH_{3\,ads} + H_{ads} \longrightarrow CH_4$$

$$2CH_2 \longrightarrow C_2H_4$$

Further reaction pathways may lead to chain growth and formation of ethanol and propanol in addition to $CH_4$ and $C_2H_4$ according to this invention.

It will be appreciated by one skilled in the art that a wide variety of configurations of electrochemical cells may be used in the practice of this invention, single cells may be used or cells may be stacked in accordance with any suitable configuration known to the art.

The process for electrochemical reduction of $CO_2$ and CO to gaseous hydrocarbon products at solid polymer electrolyte cells is achieved by provision of a suitable electrochemical cell having a solid polymer electrolyte with a metal electrocatalyst deposited on one side which is capable of providing adsorption sites for $CO_2$ and CO and chemisorbed hydrogen species and faradaically generated hydrogen species in proximity to the absorbed $CO_2$ and CO and provision of hydrogen ion from an anode chamber through the hydrogen ion conductive solid polymer electrolyte upon application of a current between the cathode and the anode to reduce at least a portion of the $CO_2$ and CO to gaseous hydrocarbon products at the solid polymer electrolyte/cathode/$CO_2$ interface. The $CO_2$ and CO gas is passed through the cathode chamber in proximity to the cathode metal electrocatalyst wherein at least a portion of the $CO_2$ and CO is reduced to gaseous hydrocarbon products such as $CH_4$ and $C_2H_4$ at the solid polymer electrolyte/cathode/$CO_2$ and CO interface, as more fully described above. Gaseous hydrocarbon products are removed from the cathode chamber and may be separated or further treated as desired in any extracellular process.

The following examples set forth specific materials and process conditions in detail and are only intended to exemplify the invention and not to limit it in any way.

EXAMPLE I

A solid polymer electrolyte cell having the configuration of FIG. 1 was constructed. Platinum was initially deposited directly onto --NAFION 117 perfluorinated sulfonic acid copolymer--; (0.017 in., $H^+$ form, equivalent weight 1100) from a 0.05M $H_2PtCl_6$ solution using IM NaOH/lM $NaBH_4$ as a reducing agent on the other side. Copper was then deposited onto the other membrane side from 0.5M $K_2SO_4$/0.05M $CuSO_4$ solution using IM NaOH/lM $NaBH_4$ on the other side. Deposition took between 15 and 30 min. Following a thorough rinse in distilled water the Pt/—NAFION 117 perfluorinated sulfonic acid copolymer--; /Cu was mounted with anode and cathode external leads from a chamber forming a cathode chamber and an anode chamber having provision for gas passage on each side of the solid polymer electrolyte as shown in FIG. 1.

EXAMPLE II

The solid polymer electrolyte (SPE) cell prepared in Example I was used for $CO_2$ reduction and had the configuration C02/Cu/—NAFION 117 perfluorinated sulfonic acid copolymer--; /Pt/$H_2$(10%)$N_2$(90%). The $CO_2$ introduced into the cathode chamber was initially passed through a hydrocarbon trap (gas-dry hydrocarbon trap, Chemcial Research Supplies) followed by oxygen removal (Oxy-Trap, Alltech Associates). No hydrocarbons were detected in the $CO_2$ gas stream after the hydrocarbon trap prior to the SPE cell. Hydrocarbon $CO_2$ reduction products exiting the cathode chamber were analyzed using a GOW-MAC Model 69-750 FID gas chromatograph using a 6 ft×⅛ in. stainless steel column packed with 80/100 mesh Carbosphere (Alltech Associates). Constant potential and current electrolyses were performed, controlled by a Stonehart BC 1200 potentiostat/galvanostat. Methane, $C_2H_4$, and $C_2H_6$ were observed as $CO_2$ reduction products. A significant observation in these cells was that a total cell voltage of only 0.65V was required at 10 mA $cm^2$ to promote $CO_2$ reduction, i.e., the Cu WE potential was <0.65V vs. SHE. Results are summarized in Table I.

TABLE I

| Total cell current (mA) | Faradaic efficiency (%) | | |
|---|---|---|---|
| | $CH_4$ | $C_2H_4$ | $C_2H_6$ |
| 22.5 | t[a] | 0.34 | t[a] |
| 30.5 | 0.071 | 0.47 | 0.10 |
| 40.4 | 0.11 | 1.68 | 0.22 |

Flow rate $CO_2$ = 10 ml $min^{-1}$, $H_2/N_2$ = 60 ml $min^{-1}$. [a]t = trace

The $CO_2$ reduction has been promoted at lower yields at Ni and Rh/SPE interface using analogous cell configurations to produce $CH_4$.

Evidence that CO species are probably intermediates in overall $CO_2$ reduction is suggested from GC analysis of CO reduction products in the cell CO/Cu/ --NAFION 117 perfluorinated sulfonic acid copolymer—; /Pt/$H_2$(10%)$N_2$(90%) where $CH_4$, $C_2H_4$, and $C_2H_6$ were observed as CO reduction products as shown in Table II.

TABLE II

| Total cell current (mA) | Time (min) | Faradaic efficiency (%) | | |
|---|---|---|---|---|
| | | $CH_4$ | $C_2H_4$ | $C_2H_6$ |
| 20 | 15 | 0.1 | 2.0 | 0.17 |
| 30 | 30 | 0.38 | 0.13 | 0.074 |
| 40 | 45 | 0.39 | 0.048 | — |
| 50 | 60 | 0.52 | 0.051 | — |
| 60 | 75 | 2.6 | — | — |

EXAMPLE III

A cell having the configuration shown in FIG. 2 was prepared in the following manner. Copper was initially deposited onto one side of a—NAFION 117 perfluorinated sulfonic acid copolymer--; membrane (0.017 in., $H^+$ form, equivalent weight 1100) from 0.5M $K_2SO_4$/0.05M $CuSO_4$ solution using 1M NaOH/1M $NaBH_4$ on the other side. Deposition took between 15 and 30 min. Following a thorough rinse in distilled water the Cu/ —NAFION 117 perfluorinated sulfonic acid copolymer--; half-cell (1.55 $cm^2$) was incorporated into the cell shown in FIG. 2, where aqueous 0.5M $K_2SO_4$ (pH 8.67) was used in the anode compartment having a Pt anode.

EXAMPLE IV

Figure 3:
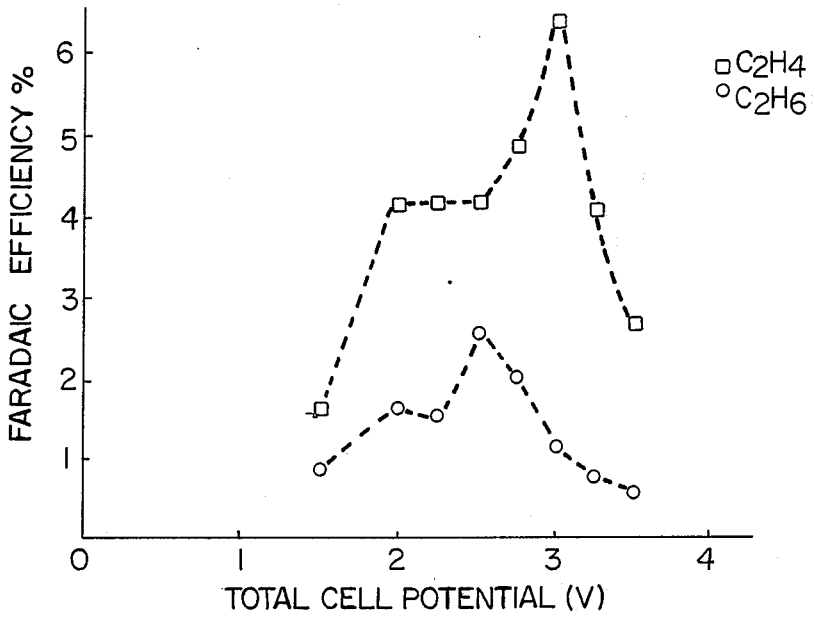
FIG. 3 is a plot of faradaic efficiency vs. Total Cell potential obtained in Example IV.

The solid polymer electrolyte cell prepared in Example III was used for $CO_2$ reduction and had the configuration $CO_2$/Cu/ —NAFION 117 perfluorinated sulfonic acid copolymer--; /$K_2SO_4$(pH 8.67)/Pt. The $CO_2$ introduced into the cathode chamber was initially passed through a hydrocarbon trap (gas-dry hydrocarbon trap, Chemical Research Supplies) followed by oxygen removal (Oxy-Trap, Alltech Associates). No hydrocarbons were detected in the $CO_2$ gas stream after the hydrocarbon trap prior to the SPE cell. Hydrocarbon $CO_2$ reduction products exiting the cathode chamber were analyzed using a GOW-MAC Model 69-750 FID gas chromatograph using a 6 ft×⅛ in. stainless steel column packed with 80/100 mesh Carbosphere (Alltech Associates). Constant potential and current electrolyses were performed, controlled by a Stonehart BC 1200 potentiostat/galvanostat. For the cell arrangement shown in FIG. 2, both $C_2H_4$ and $C_2H_6$ were observed as $CO_2$ reduction products. No $CH_4$ was observed. For this cell, the dependency of faradaic efficiency on total electrolytic cell potential is plotted in FIG. 3. over which electrolysis range the current density varied between 10 and 30 mA/$cm^2$. This performance was maintained continuously for about 38h. A significant fraction of the total cell voltage was attributed to both IR losses between the Pt counterelectrode in the 0.5M $K_2SO_4$ electrolyte and the SPE, and the oxygen evolution reaction.

EXAMPLE V

Figure 4:
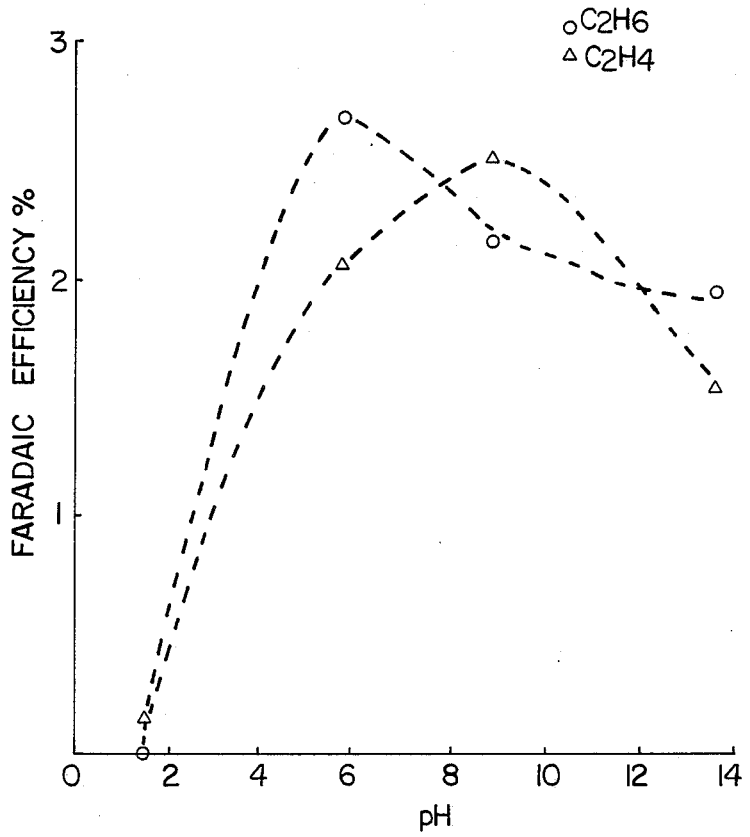
FIG. 4 is a plot of faradaic efficiency vs. pH as obtained in Example V.

A cell similar to that used in Example IV having the configuration $CO_2$/Cu/ —NAFION 117 perfluorinated sulfonic acid copolymer--. /KOH/$H_2SO_4$/Pt was operated under constant voltage conditions at I0 mA $cm^2$ and at pH's from 1.6 to 14. The faradaic efficiency of $C_2$ hydrocarbon formation vs. pH is shown in FIG. 4.

The solid polymer electrolyte cells used in the above Examples represent preliminary laboratory cells and when such solid polymer electrolyte cells are optimized one would anticipate faradaic efficiencies of hydrocarbon formation several magnitudes greater would be obtained.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for gas phase electrochemical reduction of at least one of $CO_2$ and CO to gaseous hydrocarbon products at solid polymer electrolyte cells, said process comprising: passing a current between a cathode in contact with one side of a hydrogen ion conducting solid polymer electrolyte and an anode in ionic communication with the opposite side of said solid polymer electrolyte, said cathode comprising a metal electrocatalyst deposited on said electrolyte and capable of providing adsorption sites for at least one of $CO_2$ and CO and chemisorbed hydrogen species and faradaically generated hydrogen species in proximity to said at least one of adsorbed $CO_2$ and CO; passing at least one of gaseous $CO_2$ and CO in contact with said cathode; passing hydrogen ions through said solid polymer electrolyte reducing at least a portion of said $CO_2$ and CO to gaseous hydrocarbon products comprising $CH_4$ and $C_2H_4$ at said solid polymer electrolyte/cathode interface; and removing said gaseous hydrocarbon products from the region of said cathode.

2. A process according to claim 1 wherein said cathode metal electrocatalyst is selected from the group consisting of copper, nickel, rhodium, ruthenium, and mixtures thereof.

3. A process according to claim 1 wherein said cathode metal electrocatalyst comprises copper.

4. A process according to claim 1 wherein said cathode metal electrocatalyst is loaded on said solid polymer electrolyte in an amount of about 0.01 to about 1.0 $mg/cm^2$.

5. A process according to claim 1 wherein said cathode metal electrocatalyst has a surface coating of a perfluorinated sulfonic acid copolymer.

6. A process according to claim 1 wherein said cathode metal electrocatlyst is selected from the group consisting of copper, nickel, rhodium, ruthenium, and mixtures thereof, said cathode metal electrocatlyst is loaded on said solid polymer electrolyte in an amount of about 0.01 to about 1.0 mg $cm^2$, and said cathode metal electrocatalyst has a surface coating of a perfluorinated sulfonic acid copolymer.

7. A process according to claim 1 wherein said cathode metal electrocatalyst comprises copper, said cathode metal electrocatalyst is loaded on said solid polymer electrolyte in an amount of about 0.01 to about 1.0 $mg/cm^2$, and said cathode metal electrocatlyst has a surface coating of a perfluorinated sulfonic acid copolymer.

8. A process according to claim 1 wherein said solid polymer electrolyte is a perfluorinated sulfonic acid copolymer.

9. A process according to claim 1 wherein said anode is a metal compatible with electrochemical hydrogen oxidation, said anode metal deposited on said opposite side of said solid polymer electrolyte.

10. A process according to claim 9 wherein said process additionally comprises passing gaseous hydrogen in contact with said anode.

11. A process according to claim 9 wherein said anode is selected from the group consisting of platinum, platinum alloys, and ruthenium.

12. A process according to claim 9 wherein said anode comprises platinum.

13. A process according to claim 1 wherein said anode is a metal electrode separated from said opposite side of said solid polymer electrolyte by an aqueous inorganic salt solution.

14. A process according to claim 13 wherein said inorganic salt is in a concentration of about 0.3 to about 0.8 Molar and said electrolyte is at a pH of about 4 to about 9.

15. A process according to claim 13 wherein said inorganic salt is selected from the group consisting of $KHCO_3$, $NaHCO_3$, KCl, $KClO_4$, KOH, $KBF_4$, $K_2CO_3$, $K_2SO_4$, $KH_5O_4$, $PK_2PO_4$ and $K_2HPO_4$.

16. A process according to claim 1 wherein said current is in an amount to result in current densities on said cathode of about 5 to about 50mA $cm^2$.

17. A process according to claim 1 wherein said current is in an amount to result in current densities on said cathode of about 20 to about 30mA/$cm^2$.

18. A process according to claim 1 wherein an electrochemical oxidation reaction providing organic synthesis takes place at said anode.

19. A solid polymer electrolyte cell comprising:

a cathode in contact with one side of a hydrogen ion conducting solid polymer electrolyte and an anode in ionic communication with the opposite side of said solid polymer electrolyte, said cathode comprising a metal electrocatalyst deposited on said electrolyte and capable of providing adsorption sites for at least one of $CO_2$ and CO and chemisorbed hydrogen species and faradaically generated hydrogen species in proximity to said at least one of adsorbed $CO_2$ and CO.

20. A solid polymer electrolyte cell according to claim 19 wherein said cathode metal electrocatalyst is selected from the group consisting of copper, nickel, rhodium, ruthenium, and mixtures thereof.

21. A solid polymer electrolyte cell according to claim 19 wherein said cathode metal electrocatalyst comprises copper.

22. A solid polymer electrolyte cell according to claim 19 wherein said cathode metal electrocatalyst is loaded on said solid polymer electrolyte in an amount of about 0.01 to about 1.0 -mg/$cm^2$.

23. A solid polymer electrolyte cell according to claim 19 wherein said cathode metal electrocatalyst has a surface coating of a perfluorinated sulfonic acid copolymer and said solid polymer electrolyte is a perfluorinated sulfonic acid copolymer.

24. A solid polymer electrolyte cell according to claim 19 wherein said solid polymer electrolyte is a perfluorinated sulfonic acid copolymer.

25. A solid polymer electrolyte cell according to claim 19 wherein said anode is a metal compatible with electrochemical hydrogen oxidation, said anode metal deposited on said opposite side of said solid polymer electrolyte.

26. A solid polymer electrolyte cell according to claim 19 wherein said anode is a metal electrode separated from said opposite side of said solid polymer electrolyte by an aqueous inorganic salt solution.

* * * * *